US005642686A

United States Patent [19]

Jeswine

[11] Patent Number: 5,642,686

[45] Date of Patent: Jul. 1, 1997

[54] COLLAPSIBLE BOAT

[75] Inventor: William W. Jeswine, Seattle, Wash.

[73] Assignee: Eagle Premier Ltd., Douglas, United Kingdom

[21] Appl. No.: 572,906

[22] Filed: Dec. 22, 1995

[51] Int. Cl.[6] ..... B63B 7/00

[52] U.S. Cl. ..... 114/354

[58] Field of Search ..... 114/352–354, 357, 114/343

[56] References Cited

U.S. PATENT DOCUMENTS

| | | | |
|---|---|---|---|
| 1,333,248 | 3/1920 | Di Carlo | 114/354 |
| 1,793,617 | 2/1931 | Hudson | 114/354 |
| 3,121,238 | 2/1964 | Levinson . | |
| 3,932,906 | 1/1976 | Johnson | 114/353 |
| 3,940,813 | 3/1976 | Konstantinov et al. | 9/2 C |
| 4,522,143 | 6/1985 | Holzbaur | 114/344 |
| 4,706,597 | 11/1987 | Figone | 114/353 |
| 4,730,573 | 3/1988 | Koon | 114/353 |
| 4,869,194 | 9/1989 | Cummins | 114/344 |
| 5,176,098 | 1/1993 | Royle | 114/344 |
| 5,183,002 | 2/1993 | Parker | 114/353 |
| 5,207,604 | 5/1993 | McMillin | 440/62 |
| 5,243,924 | 9/1993 | Mann | 114/61 |

FOREIGN PATENT DOCUMENTS

| | | | |
|---|---|---|---|
| 0 341 008 | 11/1989 | European Pat. Off. | B60F 3/00 |
| 2 615 475 | 11/1988 | France | B63B 7/04 |
| 37 14604 A1 | 11/1988 | Germany | B63B 7/04 |
| WO 91/17914 | 11/1991 | WIPO | 114/353 |

*Primary Examiner*—Edwin L. Swinehart
*Attorney, Agent, or Firm*—Seed and Berry LLP

[57] ABSTRACT

A collapsible boat whose lateral hull walls are retractable to reduce the width of the boat is provided. Port side and starboard side lateral hull walls are pivotally connected along their lower edges to the central hull section of the boat. When extended, the lateral hull walls form a sloping hull wall extending upward and outward from the bottom of the central hull section. When retracted, the lateral hull walls pivot inward to reduce the width of the boat. Port side and starboard side braces are pivotally connected to the upper lateral edges of the central hull section for movement between an engaged position and a retracted position. In the engaged position, the braces connect to the lateral hull walls to keep them in their extended position. In the retracted position, the braces are pivoted inward to allow the hull walls to retract.

26 Claims, 4 Drawing Sheets

Fig. 7
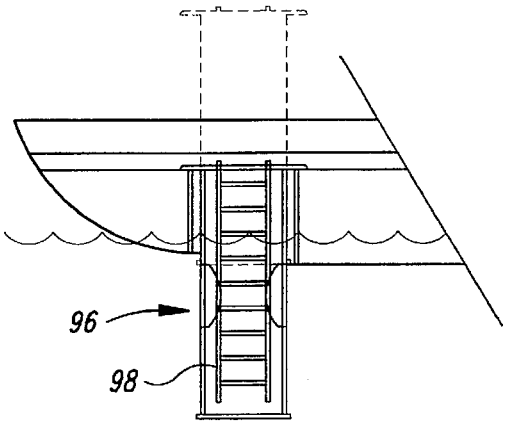
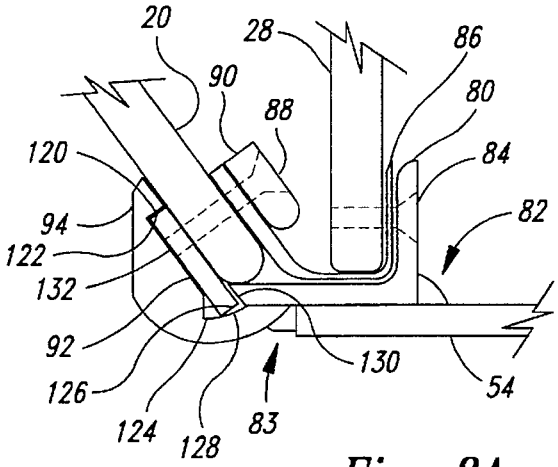
Fig. 8A
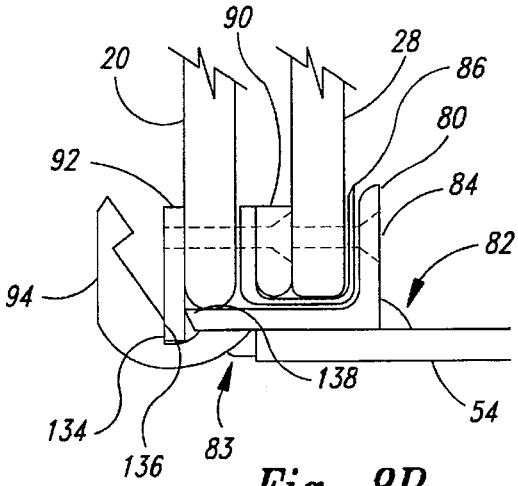
Fig. 8B
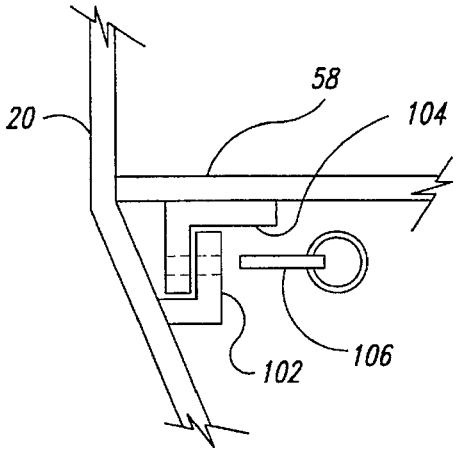
Fig. 9

COLLAPSIBLE BOAT

TECHNICAL FIELD

The present invention relates to boats, and more particularly to collapsible boats which may be collapsed for purposes of transportation and storage.

1. Background of the Invention

The attraction of water sports such as diving, water skiing and fishing has led to increased demand for boats. Despite the increased demand, financial and logistical problems of maintaining and storing a boat have discouraged many people from owning a boat. This led to development of collapsible or foldable boats that may be collapsed after use, and transported by a trailer or vehicle to be stored in small storage space. There are many collapsible boats that are known in the art. For example, a folding boat with bow and stern sections is described in U.S. Pat. No. 4,522,143, issued to Holzbauer on Jun. 11, 1985. The foldable boat includes a rearward portion mounted on hinges extending medially of the boat and arranged so as to fold forwardly over the front portion of the boat.

However, one main disadvantage of the prior art folding boats of this type is that the width of the boat in a folded position remains the same as the boat in a fully extended position. In many cases, the boat may be too wide to transport on a highway or to fit inside a truck or storage space. Another disadvantage is that the height of the boat in the folded position is higher than the boat in the extended position.

Therefore, it would be desirable to provide a more compact, collapsible boat that can be retracted laterally, longitudinally and vertically for ease of transportation and storage.

2. Summary of the Invention

According to the principles of the present invention, a collapsible boat is provided. In one embodiment, the boat has a central hull section having lateral side walls on the port and starboard sides, forward wall and rear walls, all of which are rigidly connected to the bottom of the central hull section. A port side lateral hull wall is pivotally connected along its lower edge to the central hull section on the port side. A starboard side lateral hull wall is pivotally connected along its lower edge to the central hull section on the starboard side. When extended, the lateral hull walls form a sloping hull wall extending upward and outward from the bottom of the central hull section. When retracted, the lateral hull walls pivot inward to reduce the width of the boat. Port side and starboard side braces are pivotally connected to the central hull section side for movement between an engaged position and a retracted position. In the engaged position, the braces connect to the lateral hull walls to keep them in their extended position. In the retracted position, the braces are pivoted inward to allow the hull walls to retract. Transverse plates at the ends of the sidewalls engage receiving recesses in the central hull section to prevent the entry of water.

BRIEF DESCRIPTION OF THE DRAWINGS

FIG. 7 is a side elevation view of a bow section of the collapsible boat with portions broken away illustrating a retractable observation well.

FIG. 8A–8B are detailed cross-sectional views illustrating the connection of the pivoting lateral hull wall to the rest of the boat.

FIG. 9 is a detailed cross-sectional view of a locking mechanism for connecting the deck plate to the lateral hull wall.

DETAILED DESCRIPTION OF THE INVENTION

Figure 1:
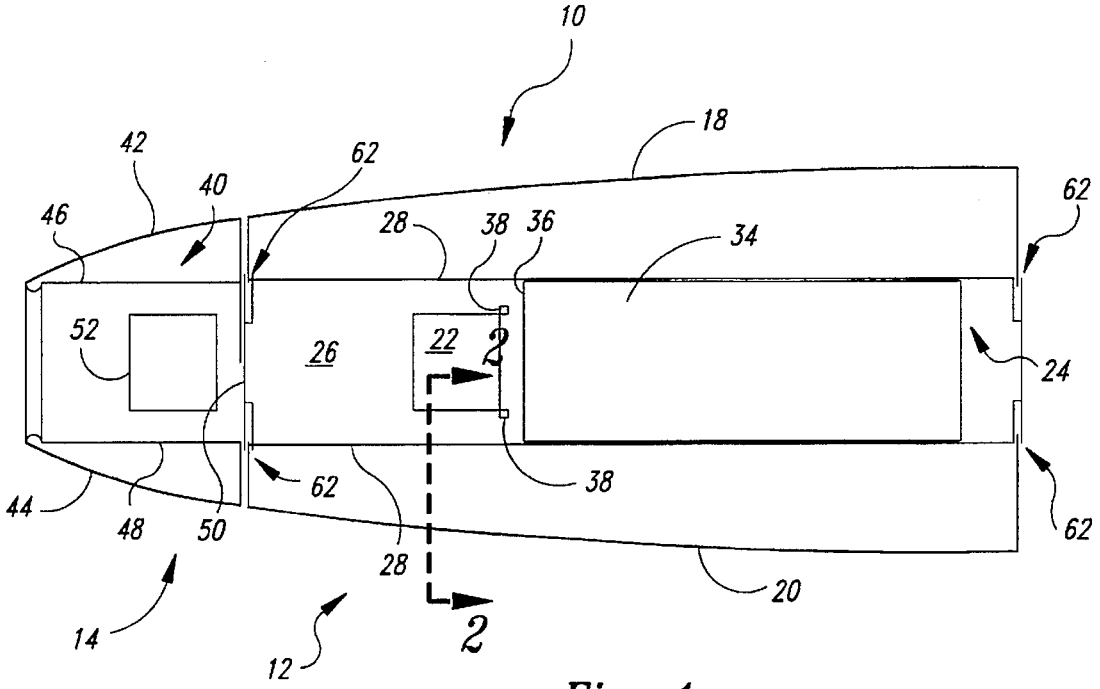
FIG. 1 is a top plan view of the collapsible boat in a fully extended position according to the present invention.

FIG. 1 is a plan view of the top side of the collapsible boat in a fully extended position according to the present invention. The collapsible boat 10 includes a main section 12 and a bow section 14. The main section 12 includes a central hull section 16, lateral hull wall 18 on the starboard side, lateral hull wall 20 on the port side, pilot house 22, deck house 24 and central deck plate 26. The central hull section 16 has a bottom and upstanding side members 28–32. The upstanding side members include lateral sidewalls 28, forward wall 30 and stern wall 32. The bottom and upstanding side members are all interconnected to each other to form with the bottom a watertight floatation unit. The central deck plate 26 is mounted on top of the central hull section 16. The hull walls 18 and 20 are pivotally connected at their lower edges to the central hull section along its lower sides. As shown in FIG. 1, the lateral hull walls 18 and 20 form sloping hull walls extending upward and outward from the bottom of the central hull section 16 in the fully extended position. In a retracted position, the hull walls 18 and 20 are pivoted inward toward the sidewalls 28 of the central hull section 16 as described in more detail later herein. The deck house 24 has a roof 34 and four sidewalls 36 which are interconnected to each other. The deck house 24 is vertically slidable. The deck house is sized so that its sides are closely received within the sidewalls 28 of the central hull section 16. This allows the deck house 24 to be lowered into the central hull section 16 in the retracted position to reduce the height of the boat 10. The pilot house 22 has a roof and enclosing walls on at least the front and sides and is pivotally connected to the central deck plate 26. Preferably, the pilot house 22 pivots about pivot points 38 positioned near the lower edges of the pilot house sidewalls and permits the pilot house to be tipped down above the retracted deck house 24 to reduce the height of the boat 10.

The bow section 14 includes a central bow member 40 and lateral bow members 42 and 44. The central bow member 40 has a bottom, upstanding sidewalls 46 and 48 and rear wall 50 which are interconnected to each other. The bottom of the central bow member 40 has a lower surface that defines a forward central hull bottom surface and extends from the forward edge of the bow section to a rear edge adjacent the bottom of the central hull section 16. In the embodiment shown, the bottom of the central bow member 40 forms along with the bottom of the central hull section a substantially continuous, central hull surface of the boat 10. The central bow member 40 is pivotally connected to the central hull section 16 to permit the central bow member to be folded up to reduce the length of the boat 10. The lateral bow members 42 and 44 are removably connected to the sidewalls 46 and 48, respectively. When attached, the lateral bow members 42 and 44 extend outward and upward from the bottom surface of the central bow member 40. When removed to reduce the width of the bow the lateral bow members are stored on the rear deck of the boat as illustrated.

Figure 2:
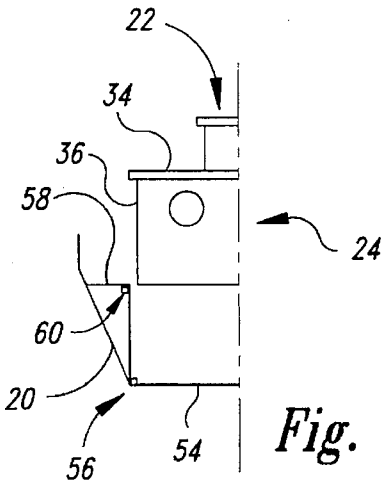
FIG. 2 is a partial cross-sectional view taken along the line 2—2 of FIG. 1.

FIG. 2 is a partial cross-sectional view taken along the line 2—2 of FIG. 1. The boat structure is symmetrical about its centerline. The lower lateral edge of the rigid, port side hull wall 20 is pivotally connected to the lower port side of the central hull section 16 at a pivot point 56. The sidewall 28 is rigidly connected to the bottom 54 of the central hull section 16. As shown in FIG. 2, a port side deck plate 58 serves as a brace to secure the hull wall 20 in the extended position. The deck plate 58 securely connects the hull wall 20, in the extended position, to the central hull section 16 through any conventional locking or fastening mechanism known in the art. The deck plate 58 is pivotally connected to the central hull section 16 at a pivot point 60 so that in the retracted position, the deck plate folds upward and inward to permit the port side lateral hull wall 20 to retract inward. Similar to the port side, a deck plate on the starboard side is pivotally connected to the central hull section 16 so that in the retracted position, the deck plate folds upward and inward to permit the starboard side lateral hull wall 18 to retract.

Figure 3:
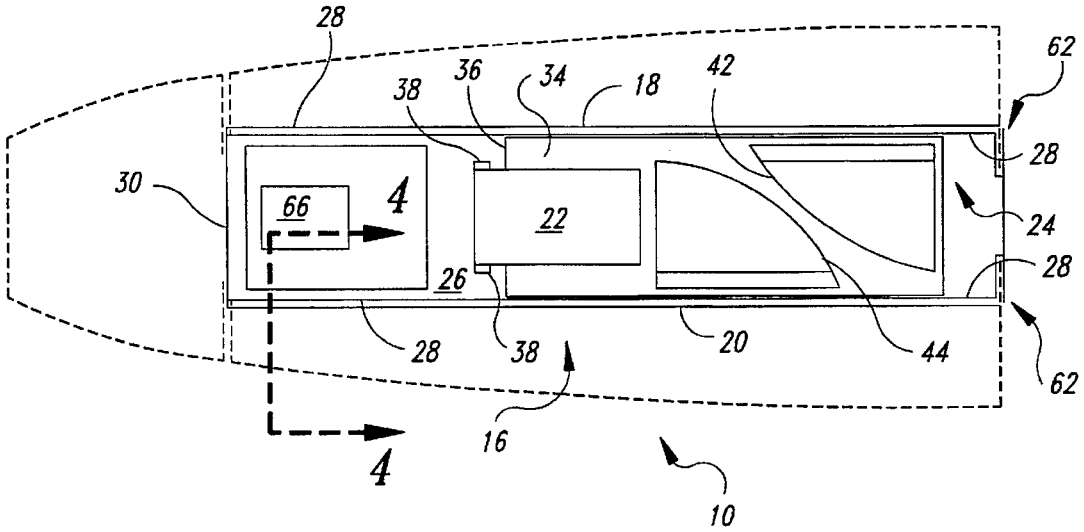
FIG. 3 is a top plan view of the collapsible boat in a collapsed position according to the present invention with the folded portions in their extended position shown in phantom.

FIG. 3 is a plan view of the top side of the collapsible boat in a collapsed position according to the present invention. The boat hull elements in the fully extended and attached positions are shown in dotted lines. As can be seen from FIG. 3, the boat realizes substantial space savings. The length of the boat 10 is reduced by the length of the bow section 14 and the width of the boat 10 is reduced to approximately the width of the central hull section 16 to provide a very compact collapsed boat for transportation or storage. The hull walls 18 and 20 are flush against the sidewalls 28 of the central hull section 16 in the retracted position. The rear and forward sections of the hull walls 18 and 20 are received inside recesses 62 in a manner more fully described below. The deck house 24 is in the retracted position. The pilot house 22 is in a tilted position and lies above the retracted deck house 24. To fold the bow section 14 over the central hull section 16, the lateral bow members 42 and 44 are removed first. Then, the bow section 14 is tilted upward and toward the stern section of the boat 10.

Figure 4:
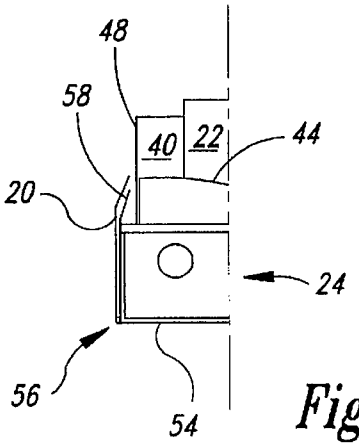
FIG. 4 is a partial cross-sectional view taken along the line 4—4 of FIG. 3.

FIG. 4 is a cross-sectional view taken along the line 4 of FIG. 3. In a retracted position, the deck plate 58 is folded upward and inward to permit the port side lateral hull wall 20 to retract. The port side hull wall 20 is pivoted inward toward the sidewall 28 of the central hull section 16. Similarly, a port side deck plate 74 of the bow section 14 is folded upward and inward to permit the port side lateral bow member 44 to retract. The port side lateral bow member 44 is pivoted inward toward the sidewall 48 of the central bow member 40. While only the port side of the cross section is shown, persons of ordinary skill in the art will appreciate that the deck plate and hull wall 20 on the starboard side are positioned symmetrically to those on the port side. Preferably, when retracted, the hull walls 18 and 20 are substantially parallel to the sidewalls 28 of the central hull section 16.

Figure 5:
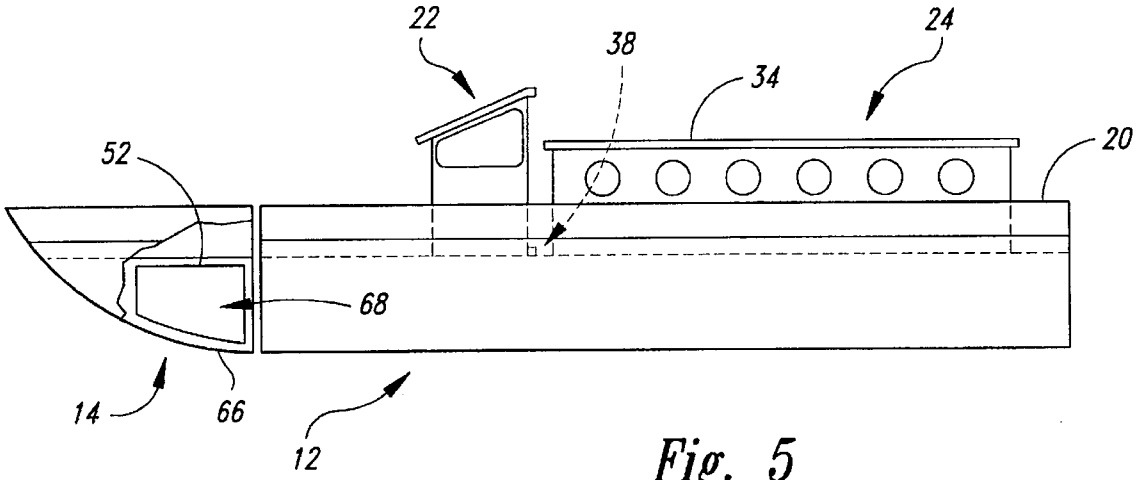
FIG. 5 is a side elevation view of the collapsible boat in a fully extended position.

FIG. 5 is a side view of the collapsible boat in the fully extended position. In this embodiment, the hatch cover provides access to an observation port at the bottom of a watertight, through-hull, well 68. A removable, observation window 66 is aligned with the lower surface of the central bow member 40 and forms a part of the substantially continuous bottom central hull surface of the boat 10. The edges of the observation window 66 is sealed to form a watertight bottom surface of the central bow member 40. The observation window 66 may be made of any transparent material such as polycarbonate material, Plexiglas, or the like. In this embodiment, a hinge 70 provides the pivotal connection between the bow section 14 and the main section 12.

Figure 6:
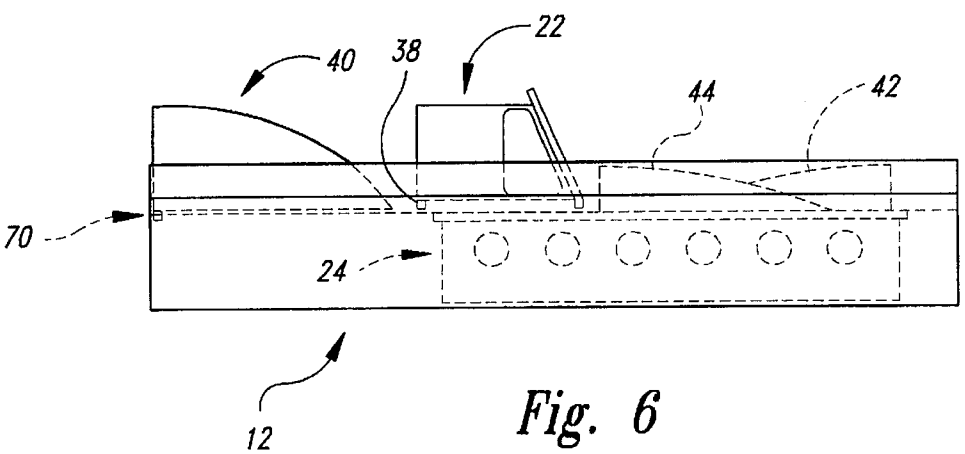
FIG. 6 is a side elevation view of the collapsible boat in a collapsed position.

FIG. 6 is a side view of the collapsible boat in a collapsed position. The following sequence is used to collapse the boat 10. Initially, the deck house 24 is lowered into the recessed area of the central hull section 16 until the roof 34 of the deck house is approximately level with the central deck plate 26. Once the deck house 24 is retracted, the pilot house 22 is rotated and tipped over the retracted deck house 24. Then, the lateral bow members 42 and 44 are removed and stored aft. Finally, the bow section 14 is folded upward and toward the stern section of the boat 10.

Referring to FIG. 7, a removable, dry observation well 96 may be provided as an alternative to the observation window 66 of FIG. 5. The observation well 96 is slidably and vertically mounted through the bow section 14. The well 96 may be raised (shown in dotted lines) or lowered using any one of well-known sliding mechanisms. A ladder 98 is provided to assist boat users to climb up and down the well 96 for viewing underwater activities.

FIG. 8A shows a detailed cross-sectional view of the pivot point 56 as shown in FIG. 2 when the hull wall 20 is in the extended position. An L-shaped member 80, extending the longitudinal length of the sidewall 28, is secured to the bottom of the hull 54, such as by welding at a weld spot 82, and supports the sidewall 28. The sidewall 28 is secured to the hull bottom 54 such as by using a plurality of flat head screws 84, spaced apart along the length of the L-shaped member 80. This fastens the sidewall 28 and an interposed portion of the inner portion of a rubber gasket 86 to the L-shaped member 80. The rubber gasket 86 extends the length of the joint and forms a water-tight seal at the lower part of the central hull section 16 with fasteners, such as a flat head screw 88, which securely fasten a gasket fastening strip 90, the outer portion of the gasket 86 and a locking strip 92 to the lower edge of the hull wall 20. In this embodiment, the outer portion of the gasket 86 forms a water-tight seal around the lower edge of the hull wall 20 to prevent water from leaking into the open area between the sidewall 28 and the hull wall 20 from below. A corner capture member 94 is secured, such as by welding at a weld spot 83 to the underside of the L-shaped member 80 and the outer edge of the bottom 54 and preferably has a smooth, curved outer surface. The inner surface forms a longitudinal locking groove that is shaped to accommodate the rotational movement of the locking strip 92. Specifically, the corner capture member 94 has an upper lip 120 spaced to closely receive the upper edge 122 of the locking strip 92 when the lateral hull wall 20 is in the extended position as shown. The corner capture member 94 has a arcuate surface 124 which slideably engages the lower edge 126 of the locking strip when the hull wall 20 is in the extended and retracted position and in all positions therebetween. A portion 128 of the arcuate surface 124 is spaced from upper lip 120 so as to closely receive the edges of the locking strip to restrict its movement when the hull wall 20 is in the extended position. The L-shaped member 80 has an outer portion that extends past the lateral edge of the bottom 54. The outer portion has a beveled edge 130 that closely receives the lower edge of the locking strip 92. The beveled edge 130 and a sloping upper section 132 of the corner capture member 94 engage opposite sides of the locking strip 92 to further restrict movement of the lateral hull wall 20 when the wall is in the extended position. The lower edge of the outer hull wall is curved and rests on the horizontal projecting portion of the L-shaped member 80.

FIG. 8B shows a detailed cross-sectional view of the pivot point 56 as shown in FIG. 4 when the hull wall 20 is in the retracted position. The hull wall 20 is pivoted inward and rests on the outer portion of the horizontal, projecting portion of L-shaped member 80. The lower upright, wall section 134 of the corner capture member 94 closely receives the lower portion of the face of the locking strip 92. As shown, the hull wall 20 is preferably substantially parallel to the sidewall 28 in the retracted position. The upright wall section 134 is spaced from the leading edge 138 of the L-shaped member to closely receive the lower portion of the locking strip. Also the thicknesses of the locking strip 92, hull wall 20, gasket strip 86 and gasket fastening strip 90 are selected such that lateral movement of the hull wall is further restricted when the hull wall is retracted. While only the port side parts are shown and described, it will be appreciated that the port side is symmetrical to the starboard side and that similar parts are used therein.

FIG. 9 is a detailed cross-sectional view of a locking mechanism 100 to securely connect the deck plate 58 to the hull wall 20 when the hull wall is in the extended position. An L-shaped member 102 is attached to the inside of the hull wall 20 and another L-shaped member 104 is attached to the underside of the deck plate 58 as shown. Holes in the L-shaped members 102 and 104 are aligned with each other and a pin member 106 is inserted through the aligned holes to securely lock the two members together. A spring loaded detent is provided to keep the pin in the installed position. Persons of ordinary skill in the art will appreciate that many other locking and fastening mechanisms may be used instead of the L-shaped members and pins.

Figure 10:
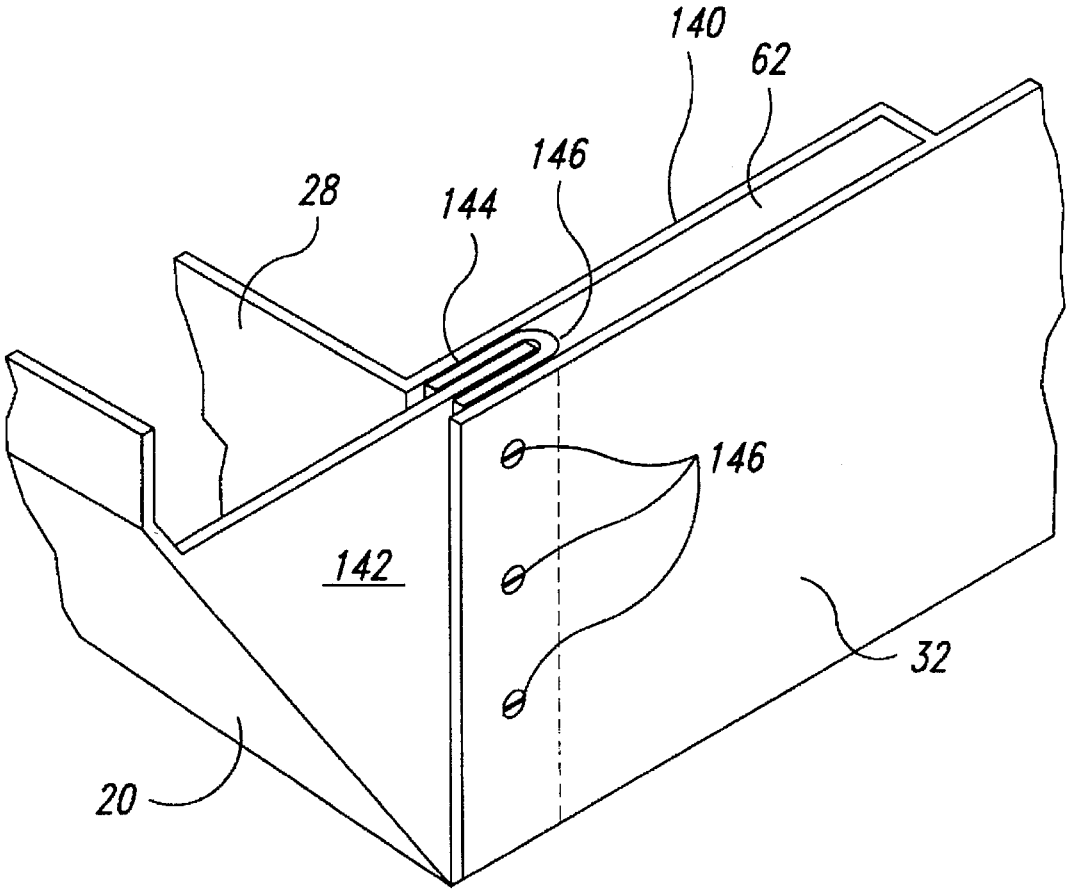
FIG. 10 is a partial, isometric view of the port, stern corner of the boat

FIG. 10 illustrates the structure which seals the ends of the hull walls 18 and 20 at their fore and aft ends. The illustrated structure on the port, stern corner is representative. Lateral hall wall 20 is shown in its extended position spaced from lateral sidewall 28 of the central hull section 16. An enclosed recess 62 is formed, in part, by a barrier plate 140 closely spaced to the end wall of the section, in this case stern wall 32. The recess thus formed closely receives a transverse sealing plate which is connected to the end of the associated hull wall, such as port, transverse stern plate 142. A sealing gasket, such as gasket strip 144 which is wrapped around the vertical edge 146 of the transverse sealing plate is used to prevent or at least minimize the entry of water to the area between the hull wall and lateral sidewall. Preferably, removable fasteners, such as, flat head screws 146 are used when the lateral hull wall is in the extended position to draw stern wall 32 and barrier plate 140 together.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A collapsible boat comprising:

a) a central hull section including a rigid and non-foldable bottom having port and starboard edges, the bottom having a bottom surface that forms the central bottom surface of the boat's hull;

b) a port side lateral hull wall pivotally connected to the central hull section along its port side for movement between an extended position where the port side lateral hull wall is extended upward and outward from the bottom of the central hull section and a retracted position where the port side lateral hull wall is retracted inward to reduce the width of the boat;

c) a port side brace pivotally connected to the central hull section for movement between an engaged position where the port side brace connects to the port side lateral hull wall to keep the port side lateral hull wall in its extended position and a retracted position to permit the port side lateral hull wall to retract;

d) a starboard side lateral hull wall pivotally connected to the central hull section along its starboard side for movement between an extended position where the starboard side lateral hull wall is extended upward and outward from the bottom of the central hull section and a retracted position where the starboard side lateral hull wall is retracted inward to reduce the width of the boat; and e) a starboard side brace pivotally connected to the central hull section for movement between an engaged position where the starboard side brace connects to the starboard side lateral hull wall to keep the starboard side lateral hull wall in its extended position and a retracted position to permit the starboard side lateral hull wall to retract.

2. The collapsible boat according to claim 1, further comprising:

a flexible sealing member on each side of the boat extending substantially the length of the central hull section between a lower portion of each side hull wall and the adjacent bottom of the central hull section.

3. The collapsible boat according to claim 2, further comprising:

a locking strip on each side of the boat secured to the outside of an associated side hull wall; and a corner capture member on each side of the boat which is secured to the central hull section, each corner capture member having an inner surface defining a longitudinal groove for closely receiving an associated locking strip.

4. The collapsible boat according to claim 3 wherein each locking strip has an upper edge and a lower edge and each corner capture member further includes an upper wall forming the top of the groove for engaging the upper edge of the locking strip and a lower wall forming the bottom of the groove and forming an arcuate surface for slidably engaging the lower edge of the locking strip when the associated side hull wall moves between the extended and retracted positions.

5. The collapsible boat according to claim 4 wherein each locking strip has an inner face and wherein there is an outer surface at each of the outer edges of the central hull section which engages the inner face of the associated locking strip when the associated side hull wall is in the extended position.

6. The collapsible boat according to claim 4 wherein each corner capture member has an upright face that engages a lower portion of the outer face of the locking strip when the associated side hull wall is in the retracted position, and wherein each corner capture member has a face above the upright face at an angle with respect to the upright face which engages an upper portion of the outer face of the associated locking strip when the associated side hull wall is in the extended position.

7. The collapsible boat according to claim 6 wherein the central hull section has an upright sidewall on either side thereof and wherein the upright face of the associated corner capture member is spaced from the upright sidewall to closely receive the locking strip to limit lateral movement of the associated side hull wall when the associated side hull wall is in the retracted position.

8. The collapsible boat according to claim 7 wherein the central hull section includes a stern wall connected to the bottom of the central hull section, each of the side hull walls includes a transverse plate projecting centrally for preventing the entry of water, and wherein each side of the central hull section includes a wall member defining a recess for closely receiving the transverse plate on the associated side hull wall when it is in the retracted position.

9. The collapsible boat according to claim 1 wherein the central hull section includes a stern wall connected to the bottom of the central hull section, each of the side hull walls includes a transverse plate projecting centrally for preventing the entry of water, and wherein each side of the central hull section includes a wall member defining a recess for closely receiving the transverse plate on the associated side hull wall when it is in the retracted position.

10. The collapsible boat according to claim 1, further comprising:

a central bow member having a lower surface defining a forward central hull bottom surface extending from the forward end to a rear edge adjacent the bottom of the central hull section to form a central hull bottom surface of the boat in which the central bow member is pivotally connected to the central hull section to permit the central bow member to be folded up to reduce the length of the boat.

11. The collapsible boat according to claim 10 wherein the central bow member further comprises:

a lateral port bow member having a lower surface which form a substantially continuous extension of the boat bow, port side hull wall and central hull bottom and which is removably connected to the central bow member to reduce the width of the boat; and a lateral starboard bow member having a lower surface which form a substantially continuous extension of the boat bow, port side hull wall and central hull bottom and which is removably connected to the central bow member to reduce the width of the boat.

12. The collapsible boat according to claim 1, further comprising:

a pilot house having enclosing sidewalls on at least the front and sides which is pivotally connected to the central hull section for movement between an upright position and a lowered position to reduce the height of the boat.

13. The collapsible boat according to claim 1, further comprising:

a deckhouse having a roof and lateral sidewalls depending therefrom which are positioned to be closely received within the sidewalls of the central hull section permitting the deckhouse to be lowered to a retracted position to reduce the height of the boat.

14. A collapsible boat comprising:

a) a central hull section having a bottom and upstanding side members including port side and starboard side lateral sidewalls, a forward wall and a stern wall, in which the bottom and the upstanding side members are interconnected to each other to form a watertight flotation element;

b) a port side lateral hull wall pivotally connected at its lower edge to the central hull along its lower port side for movement between an extended position where the port side lateral hull wall forms a sloping hull wall extending upward and outward from the bottom of the central hull section and a retracted position where the port side hull wall is substantially parallel to the port side sidewall of the central hull section to reduce the width of the boat;

c) a port side deck plate extending substantially the length of the central hull section and pivotally connected to the central hull section along its upper port side for movement between an horizontal position where an outboard edge of the port side deck plate connects to the port side lateral hull wall in its extended position to form a deck and to help keep the port side lateral hull wall in its extended position and a retracted position to reduce the width of the boat and permit the port side lateral hull wall to retract;

d) a starboard side lateral hull wall pivotally connected at its lower edge to the central hull section along its lower starboard side for movement between an extended position where the starboard side lateral hull wall forms a sloping hull wall extending upward and outward from the bottom of the central hull section and a retracted position where the starboard side hull wall is substantially parallel to the starboard side sidewall of the central hull section to reduce the width of the boat;

e) a starboard side deck plate extending substantially the length of the central hull element and pivotally connected to the central hull section along its upper starboard side for movement between an horizontal position where an outboard edge of the starboard side deck plate connects to the starboard side lateral hull wall in its extended position to form a deck and to help keep the starboard side later hull wall in its extended position and a retracted position to reduce the width of the boat and permit the starboard side lateral hull wall to retract.

15. A collapsible boat comprising:

a) a central hull section having a bottom and upstanding side members including lateral sidewalls and a forward wall and stem wall, interconnected to each other and the bottom to form a watertight flotation element;

b) a port side lateral hull wall pivotally connected at a lower edge to the central hull along its lower port side for movement between an extended position where the port side lateral hull wall forms a sloping hull wall extending upward and outward from the bottom of the central hull section and a retracted position where the port side hull wall is substantially parallel to the port sidewall of the central hull section to reduce the width of the boat;

c) a port side deck plate extending substantially the length of the central hull section and pivotally connected to the, central hull section along its upper port side for movement between an horizontal position where its outboard edge connects to the port side lateral hull wall in its extended position to form a deck and to help keep the port side lateral hull wall in its extended position and an upright position to reduce the width of the boat and permit the port side lateral hull wall to retract;

d) a starboard side lateral hull wall pivotally connected at its lower edge to the central hull section along its lower starboard side for movement between and extended position where the starboard side lateral hull wall forms a sloping hull wall extending upward and outward from the bottom of the central hull section and a retracted position where the starboard side hull wall is substantially parallel to the starboard sidewall of the central hull section to reduce the width of the boat;

e) a starboard side deck plate extending the substantially the length of the central hull element and pivotally connected to the central hull element along its upper starboard side for movement between an horizontal position where its outboard edge connects to the starboard side lateral hull wall in its extended position to form a deck and to help keep the starboard side lateral hull wall in its extended position and an upright position to reduce the width of the boat and permit the starboard side lateral hull wall to retract;

f) a central bow member having a lower surface defining a forward central hull bottom surface extending from the forward end to a rear edge adjacent the bottom of the central hull section to form a substantially continuous, bottom, central hull surface of the boat and which is pivotally connected to the central hull section to permit the central bow member to be folded up to reduce the length of the boat;

g) a lateral port bow member having a lower surface which form a substantially continuous extension of the boat bow, port side hull wall and central hull bottom and which is removably connected to the central bow member to reduce the width of the boat;

h) a lateral starboard bow member having a lower surface which form a substantially continuous extension of the boat bow, starboard side hull wall and central hull bottom and which is removably connected to the central bow member to reduce the width of the boat;

i) a pilot house having enclosing sidewalls on at least the front and sides which is pivotally connected to the central hull section for movement between an upright position and a lowered position to reduce the height of the boat; and j) a deckhouse having a roof and lateral sidewalls depending therefrom which are positioned to be closely received within the sidewalls of the central hull section permitting the deckhouse to be lowered to a retracted position to reduce the height of the boat.

16. A collapsible boat comprising:

a central hull section including a bottom having port and starboard edges, the bottom having a bottom surface that forms the central bottom surface of the boat's hull;

a port side lateral hull wall pivotally connected to the central hull section along its port side for movement between an extended position where the port side lateral hull wall is extended upward and outward from the bottom of the central hull section and a retracted position where the port side lateral hull wall is retracted inward to reduce the width of the boat;

a port side brace pivotally connected to the central hull section for movement between an engaged position where the port side brace connects to the port side lateral hull wall to keep the port side lateral hull wall in its extended position and a retracted position to permit the port side lateral hull wall to retract;

a starboard side lateral hull wall pivotally connected to the central hull section along its starboard side for movement between an extended position where the starboard side lateral hull wall is extended upward and outward from the bottom of the central hull section and a retracted position where the starboard side lateral hull wall is retracted inward to reduce the width of the boat;

a starboard side brace pivotally connected to the central hull section for movement between an engaged position where the starboard side brace connects to the starboard side lateral hull wall to keep the starboard side lateral hull wall in its extended position and a retracted position to permit the starboard side lateral hull wall to retract;

a flexible sealing member on each side of the boat extending substantially the length of the central hull section between a lower portion of each side hull wall and the adjacent bottom of the central hull section;

a locking strip on each side of the boat secured to the outside of an associated side hull wall;

a corner capture member on each side of the boat which is secured to the central hull section, each corner capture member having an inner surface defining a longitudinal groove for closely receiving the associated locking strip; and wherein each locking strip has an upper edge and a lower edge and each corner capture member further includes an upper wall forming the top of the groove for engaging the upper edge of the locking strip and a lower wall forming the bottom of the groove and forming an arcuate surface for slidably engaging the lower edge of the locking strip when the associated side hull wall moves between the extended and retracted positions.

17. The collapsible boat according to claim 16 wherein each locking strip has an inner face and wherein there is an outer surface at each of the outer edges of the central hull section which engages the inner face of the associated locking strip when the associated side hull wall is in the extended position.

18. The collapsible boat according to claim 16 wherein each corner capture member has an upright face that engages a lower portion of the outer face of the locking strip when the associated side hull wall is in the retracted position, and wherein each corner capture member has a face above the upright face at an angle with respect to the upright face which engages an upper portion of the outer face of the associated locking strip when the port side hull wall is in the extended position.

19. The collapsible boat according to claim 18 wherein the central hull section has an upright sidewall on either side thereof and wherein the upright face of the associated corner capture member is spaced from the upright sidewall to closely receive the locking strip to limit lateral movement of the associated side hull wall when the associated side hull wall is in the retracted position.

20. The collapsible boat according to claim 19 wherein the central hull section includes a stem wall connected to the bottom of the central hull section, each of the side hull walls includes a transverse plate projecting centrally for preventing the entry of water, and wherein each side of the central hull section includes a wall member defining a recess for closely receiving the transverse plate on the associated side hull wall when it is in the retracted position.

21. A collapsible boat, comprising:

a central hull section including a bottom having port and starboard edges, the bottom having a bottom surface that forms the central bottom surface of the boat's hull;

a port side lateral hull wall pivotally connected to the central hull section along its port side for movement between an extended position where the port side lateral hull wall is extended upward and outward from the bottom of the central hull section and a retracted position where the port side lateral hull wall is retracted inward to reduce the width of the boat;

a port side brace pivotally connected to the central hull section for movement between an engaged position where the port side brace connects to the port side lateral hull wall to keep the port side lateral hull wall in its extended position and a retracted position to permit the port side lateral hull wall to retract;

a starboard side lateral hull wall pivotally connected to the central hull section along its starboard side for movement between an extended position where the starboard side lateral hull wall is extended upward and outward from the bottom of the central hull section and a retracted position where the starboard side lateral hull wall is retracted inward to reduce the width of the boat;

a starboard side brace pivotally connected to the central hull section for movement between an engaged position where the starboard side brace connects to the starboard side lateral hull wall to keep the starboard side lateral hull wall in its extended position and a retracted position to permit the starboard side lateral hull wall to retract; and wherein the central hull section includes a stem wall connected to the bottom of the central hull section, each of the side hull walls includes a transverse plate projecting centrally for preventing the entry of water, and wherein each side of the central hull section includes a wall member defining a recess for closely receiving the transverse plate on the associated side hull wall when it is in the retracted position.

22. A collapsible boat, comprising:

a central hull section including a bottom having port and starboard edges, the bottom having a bottom surface that forms the central bottom surface of the boat's hull;

a port side lateral hull wall pivotally connected to the central hull section along its port side for movement between an extended position where the port side lateral hull wall is extended upward and outward from the bottom of the central hull section and a retracted position where the port side lateral hull wall is retracted inward to reduce the width of the boat;

a port side brace pivotally connected to the central hull section for movement between an engaged position where the port side brace connects to the port side lateral hull wall to keep the port side lateral hull wall in its extended position and a retracted position to permit the port side lateral hull wall to retract;

a starboard side lateral hull wall pivotally connected to the central hull section along its starboard side for movement between an extended position where the starboard side lateral hull wall is extended upward and outward from the bottom of the central hull section and a retracted position where the starboard side lateral hull wall is retracted inward to reduce the width of the boat;

a starboard side brace pivotally connected to the central hull section for movement between an engaged position where the starboard side brace connects to the starboard side lateral hull wall to keep the starboard side lateral hull wall in its extended position and a retracted position to permit the starboard side lateral hull wall to retract; and a central bow member having a lower surface defining a forward central hull bottom surface extending from the forward end to a rear edge adjacent the bottom of the central hull section to form a central hull bottom surface of the boat in which the central bow member is pivotally connected to the central hull section to permit the central bow member to be folded up to reduce the length of the boat.

23. The collapsible boat according to claim 22 wherein the central bow member further comprises:

a lateral port bow member having a lower surface which form a substantially continuous extension of the boat bow, port side hull wall and central hull bottom and which is removably connected to the central bow member to reduce the width of the boat; and a lateral starboard bow member having a lower surface which form a substantially continuous extension of the boat bow, port side hull wall and central hull bottom and which is removably connected to the central bow member to reduce the width of the boat.

24. A collapsible boat, comprising:

a central hull section including a bottom having port and starboard edges, the bottom having a bottom surface that forms the central bottom surface of the boat's hull;

a port side lateral hull wall pivotally connected to the central hull section along its port side for movement between an extended position where the port side lateral hull wall is extended upward and outward from the bottom of the central hull section and a retracted position where the port side lateral hull wall is retracted inward to reduce the width of the boat;

a port side brace pivotally connected to the central hull section for movement between an engaged position where the port side brace connects to the port side lateral hull wall to keep the port side lateral hull wall in its extended position and a retracted position to permit the port side lateral hull wall to retract;

a starboard side lateral hull wall pivotally connected to the central hull section along its starboard side for movement between an extended position where the starboard side lateral hull wall is extended upward and outward from the bottom of the central hull section and a retracted position where the starboard side lateral hull wall is retracted inward to reduce the width of the boat;

a starboard side brace pivotally connected to the central hull section for movement between an engaged position where the starboard side brace connects to the starboard side lateral hull wall to keep the starboard side lateral hull wall in its extended position and a retracted position to permit the starboard side lateral hull wall to retract; and a pilot house having enclosing sidewalls on at least the front and sides which is pivotally connected to the central hull section for movement between an upright position and a lowered position to reduce the height of the boat.

25. A collapsible boat, comprising:

a central hull section including a bottom having port and starboard edges, the bottom having a bottom surface that forms the central bottom surface of the boat's hull;

a port side lateral hull wall pivotally connected to the central hull section along its port side for movement between an extended position where the port side lateral hull wall is extended upward and outward from the bottom of the central hull section and a retracted position where the port side lateral hull wall is retracted inward to reduce the width of the boat;

a port side brace pivotally connected to the central hull section for movement between an engaged position where the port side brace connects to the port side lateral hull wall to keep the port side lateral hull wall in its extended position and a retracted position to permit the port side lateral hull wall to retract;

a starboard side lateral hull wall pivotally connected to the central hull section along its starboard side for movement between an extended position where the starboard side lateral hull wall is extended upward and outward from the bottom of the central hull section and a retracted position where the starboard side lateral hull wall is retracted inward to reduce the width of the boat;

a starboard side brace pivotally connected to the central hull section for movement between an engaged position where the starboard side brace connects to the starboard side lateral hull wall to keep the starboard side lateral hull wall in its extended position and a retracted position to permit the starboard side lateral hull wall to retract; and a deckhouse having a roof and lateral sidewalls depending therefrom which are positioned to be closely received within the sidewalls of the central hull section permitting the deckhouse to be lowered to a retracted position to reduce the height of the boat.

26. A collapsible boat, comprising:

a central hull section having a bottom and upstanding side members including port side and starboard side lateral sidewalls, a forward wall and a stem wall, in which the bottom and the upstanding side members are interconnected to each other to form a watertight flotation element;

a port side lateral hull wall pivotally connected to the central hull section along its port side for movement between an extended position where the port side lateral hull wall is extended upward and outward from the bottom of the central hull section and a retracted position where the port side lateral hull wall is retracted inward to reduce the width of the boat;

a port side brace pivotally connected to the central hull section for movement between an engaged position where the port side brace connects to the port side lateral hull wall to keep the port side lateral hull wall in its extended position and a retracted position to permit the port side lateral hull wall to retract;

a starboard side lateral hull wall pivotally connected to the central hull section along its starboard side for movement between an extended position where the starboard side lateral hull wall is extended upward and outward from the bottom of the central hull section and a retracted position where the starboard side lateral hull wall is retracted inward to reduce the width of the boat; and a starboard side brace pivotally connected to the central hull section for movement between an engaged position where the starboard side brace connects to the starboard side lateral hull wall to keep the starboard side lateral hull wall in its extended position and a retracted position to permit the starboard side lateral hull wall to retract.

* * * * *